US006332799B1

(12) United States Patent
Torii et al.

(10) Patent No.: US 6,332,799 B1
(45) Date of Patent: Dec. 25, 2001

(54) HALF-FITTING PREVENTION CONNECTOR

(75) Inventors: Chieko Torii; Tomomi Endo, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/865,684

(22) Filed: May 29, 2001

(30) Foreign Application Priority Data

May 29, 2000 (JP) ..... 12-158530

(51) Int. Cl.[7] ..... H01R 13/627
(52) U.S. Cl. ..... 439/352; 439/953
(58) Field of Search ..... 439/352, 350, 439/953, 489

(56) References Cited

U.S. PATENT DOCUMENTS

| | | | | |
|---|---|---|---|---|
| 5,749,747 | | 5/1998 | Inaba et al. | 439/358 |
| 5,820,399 | * | 10/1998 | Shirouzu | 439/352 |
| 5,938,466 | | 8/1999 | Suzuki et al. | 439/352 |

FOREIGN PATENT DOCUMENTS

| | | | |
|---|---|---|---|
| 9-55261 | 2/1997 | (JP) | H01R/13/64 |
| 9-180820 | 7/1997 | (JP) | H01R/13/64 |

OTHER PUBLICATIONS

Japanese Abstract No. 9–180820 Nov. 7, 1997.
Japanese Abstract No. 9–055261 Feb. 25, 1997.

* cited by examiner

*Primary Examiner*—Paula Bradley
*Assistant Examiner*—Briggitte R. Hammond
(74) *Attorney, Agent, or Firm*—Sughrue Mion, PLLC

(57) ABSTRACT

In a half-fitting prevention connector (1), a flexible lock arm (5) is formed on a housing (4) of a male connector (2) and has a slide slot (8). A spring member (11), which is attachable to the housing (4), includes a slide member (14) slidably supported by the housing (4), and a compression spring (12), wherein a front end portion of the compression spring (12) is integrally formed with the slide member (14). A rear end portion of the compression spring (12) is fixedly secured to the housing (4). The slide member (14) has an abutment portion (16) abutted against a stopper projection (26) of a housing (21) of a female connector (3), and a guide frame (15) which is slidably guided in and along the slide slot (8).

6 Claims, 10 Drawing Sheets

PRIOR ART

PRIOR ART

HALF-FITTING PREVENTION CONNECTOR

BACKGROUND OF THE INVENTION

1. Field of the Invention

The present invention relates to a half-fitting prevention connector which reliably prevents half-fitting by way of the resiliency of a resilient member attached to a housing of at least one of a pair of male and female connectors which are fittable to each other, and which reliably effects fitting and locking with the mating connector.

The present application is based on Japanese Patent Application No. 2000-158530, which is incorporated herein by reference.

2. Description of the Related Art

A related example of a half-fitting prevention connector now will be described with reference to FIGS. 6 to 10.

As shown in FIGS. 6 to 8, in a half-fitting prevention connector 51, half-fitting between a pair of male and female connectors 52 and 53 which are fittable to each other is prevented by the resiliency of a pair of compression coil springs 57 accommodated in spring accommodating portions 56 on both sides in an exclusive housing 55 provided integrally on a housing 54 of the male connector 52.

In addition, the male connector 52 has a lock arm 58 which has on a lower surface of its tip an engaging projection 59 for retaining the mating female connector 53 and which is flexibly supported in the housing 54. Further, a slider 62 serving as a sliding member is slidably held in the exclusive housing 55.

Further, displacement preventing projections 60 are provided on an upper surface of the lock arm 58 on the opposite side to the side where the engaging projection 59 is provided, and a lock peak 61 is provided on the upper surface of its root portion. In addition, the exclusive housing 55 essentially serves to allow the slider 62 to slide in its axial direction and hold it, and a large portion of it is formed as a slider accommodating portion 63 with its upper portion open. A pair of side spaces 64 and a pair of guide grooves 65 are provided on both sides of the lock arm 58 to allow the slider 62 to slide therein in a straddling manner.

The slider 62 has a slider body 66 which is adapted to slide while being guided along the guide grooves 65. A pair of spring receiving portions 67 are provided on both sides of a rear end of the slider body 66 to retain and compress the respective compression springs 57 in the direction toward the spring accommodating portions 56 along the guide grooves 65.

In addition, the slider body 66 has a U-shaped notch 68 for holding a displacement preventing portion 71 provided at its front end. Further, a slider arm 69 which is deflectable upwardly by using a rear portion of the slider body 66 as a root is formed in the slider body 66. A pair of abutment projections 70 are provided on the lower surface of a front end of the slider arm 69 so as to be able to slide in the side spaces 64.

The displacement preventing portion 71 whose lower surface is recessed is provided at the front end of the slider body 66 so as to prevent the displacement of the lock arm 58 when the displacement preventing projections 60 have abutted against the displacement preventing portion 71. Further, a pressing portion 72 which can be pressed in the rearward direction is provided on the upper surface of a rear end portion of the slider body 66. A slide slot 73 of a rectangular shape is provided in a central portion of the slider arm 69 in front of the pressing portion 72. The lock peak 61 is capable of moving back and forth in the slide slot 73.

It should be noted that a lower portion of the housing 54 is formed as a male connector housing 74 so as to be fitted with inner surfaces of a female connector housing 76.

Further, an inclined projection 77, which is retained by the engaging projection 59, and a pair of stopper projections 78, which abuts against the abutment projections 70 of the slider 62, are provided on an upper surface of a female housing 75.

In the half-fitting prevention connector having the above-described construction, as shown in FIG. 6, after the pair of compression springs 57 are first inserted in the spring accommodating portions 56 of the exclusive housing 55 of the male connector 52, if the slider 62 is inserted along the guide grooves 65, the lower portion of the front end of the pressing portion 72 rides over the lock peak 61 while deflecting the lock arm 58 downward.

Then, if the inserting force is canceled as shown in FIG. 7, the front end of the pressing portion 72 of the slider 62, which is being urged in the forward direction by the compression springs 57, abuts against the lock peak 61, so that the slider 62 is positioned in a state of being slidable inside the housing 54.

Next, after a pair of female terminals 41 each having a covered wire W connected to the respective rear portion are fitted in the male connector housing 74, and a pair of male terminals 42 each having a covered wire W connected thereto are fitted in the female connector housing 75, the male and female connectors 52 and 53 made to face each other and are pressed in the connector fitting direction, as shown in FIG. 8.

Consequently, the stopper projections 78 on the female housing 75 abut against the abutment projections 70 of the slider 62, and the slider 62 is pushed in toward the rear of the housing 54 while compressing the compression springs 57. Afterwards, as the engaging projection 59 rides over the inclined projection 77, the lock arm 58 is deflected upward, while the slider arm 69 is deflected upward by riding over the lock peak 61.

If the fitting forces of the male and female connectors 52 and 53 are canceled at this stage, the slider 62 is pushed back by the urging forces of the compression springs 57, so that the female connector 53 is pushed back by the abutment projections 70 and the stopper projections 78, thereby preventing the male and female connectors 52 and 53 from being left in a half-fitted state.

In addition, because the upper portion of the exclusive housing 55 is open, the half-fitted state of the connectors can be also visually confirmed since the pressing portion 72 is located at the rear end portion of the exclusive housing 55, as shown in FIG. 8.

If the fitting operation is further advanced, as shown in FIG. 9, the slider arm 69 is deflected further upward by the lock peak 61 and the abutment projections 70 are disengaged from the stopper projections 78, with the result that the slider 62 is pushed back forwardly by the urging forces of the compression springs 57, and the front end of the pressing portion 72 abuts against the lock peak 61 and stops.

At this time, since the engaging projection 59 is retained by the inclined projection 77, the deflection of the lock arm 58 also returns to its original state, and the displacement preventing portion 71 of the slider 62 which returned to its original state is fitted over the displacement preventing projections 60 of the lock arm 58. Consequently, the lock arm 58 becomes no longer deflectable, thereby assuming a completely fitted state of the connectors. Also, since the position of the pressing portion 72 comes to be located on the front side from the rear end, the completely fitted state of the connectors can be confirmed visually.

Next, to cancel the fitting between the male and female connectors 52 and 53, as shown in FIG. 10, an operator pulls the pressing portion 72 in the rearward direction while compressing the compression springs 57 while holding the housing 75. Consequently, the slider 62 retracts to allow the displacement preventing projections 60 to be canceled from the state of being locked by the displacement preventing portion 71, and since the abutment projections 70 ride over the stopper projections 78, the slider 69 begins to be deflected upward.

If the pressing portion 72 is further pulled, at the same time as the tip portion of the slider arm 69 rides over the lock peak 61, the engaging projection 59 becomes unlocked from the inclined projection 77, so that the fitting between the male and female connectors 52 and 53 can be canceled.

However, with the above-described, half-fitting prevention connector 51, there has been a possibility that since the slider 62 is required, the number of component parts increases, and the number of assembling steps increases, leading to higher cost.

In addition, since when the pressing portion 72 is pulled backward during releasing operation of the connectors, the pressing portion 72 must be pulled while compressing the compression springs, there has been a possibility that the operating efficiency during the releasing operation is poor.

Furthermore, since the lock arm 58 and the slider arm 69 need to be deflected greatly during the fitting and releasing operation of the connectors 52 and 53, the durability of the connector must be considered.

SUMMARY OF THE INVENTION

The present invention has been devised in view of the undesired possibilities in the related art, and its object is to provide a half-fitting prevention connector which has a small number of component parts, offers satisfactory operating efficiency during releasing operation of the connectors, and excels in the durability with small deflection of resin portions of the connector during fitting and releasing operation.

To achieve the above object, according to a first aspect of the present invention, there is provided a half-fitting prevention connector which comprises:

a first connector including a first housing;

a flexible lock arm formed on the first housing, the flexible lock arm having a first retaining portion and a guide portion;

a second connector fittable to the first connector, the second connector including a second housing having a second retaining portion and a stopper portion; and a spring member attachable to the first housing, the spring member including:

a resilient portion, a rear end portion of which is fixedly secured to the first housing, and a slide member integrally formed with a front end portion of the resilient portion, the slide member including an abutment portion and a guide section which is slidably guided by the guide portion of the flexible lock arm, wherein when the first connector and the second connector are about to be fitted to each other, the flexible lock arm is flexed while causing the abutment portion of the slide member to abut against the stopper portion of the second housing, wherein when the first connector and the second connector are incompletely fitted, the first connector and the second connector are released in a direction opposite to a connector fitting direction in accordance with a resilient force of the resilient portion of the spring member, and wherein when the first connector and the second connector are completely fitted to each other, the first retaining portion of the flexible lock arm is retained by the second retaining portion of the second housing.

In accordance with the first aspect of the present invention, since a slider is not required, the number of component parts for the half-fitting prevention connector can be reduced, the structure is simplified, and the number of assembling steps can be reduced, thereby making it possible to lower the cost. Furthermore, since the amount of the flexion of the lock arm during fitting and releasing operation of the male and female connectors is small, and resin members other than the lock arm need not be flexed, it is possible to improve the durability of the connector.

In addition, since the spring member is not compressed during unlocking operation, it is unnecessary to pull back an operating portion against the urging force of the spring member during releasing operation of the connectors, so that the releasing operation is facilitated. Accordingly, it is possible to improve the operating efficiency during releasing operation.

Further, to achieve the above object, according to a second aspect of the present invention, there is provided a half-fitting prevention connector which comprises:

a first connector including a first housing;

a flexible lock arm formed on the first housing, the flexible lock arm having a first retaining portion and a slide slot which is formed in the flexible lock arm so as to extend from a tip of the flexible lock arm;

a second connector fittable to the first connector, the second connector including a second housing having a second retaining portion and a stopper portion; and a spring member attachable to the first housing, the spring member including:

a resilient portion, a rear end portion of which is fixedly secured to the first housing, and a slide member integrally formed with a front end portion of the resilient portion, the slide member including an abutment portion and a guide frame which is slidably guided in the slide slot of the flexible lock arm, wherein when the first connector and the second connector are about to be fitted to each other, the flexible lock arm is flexed while causing the abutment portion of the slide member to abut against the stopper portion of the second housing, wherein when the first connector and the second connector are incompletely fitted, the first connector and the second connector are released in a direction opposite to a connector fitting direction in accordance with a resilient force of the resilient portion of the spring member, and wherein when the first connector and the second connector are completely fitted to each other, the first retaining portion of the flexible lock arm is retained by the second retaining portion of the second housing.

In accordance with the second aspect of the present invention, the assembling operation is facilitated, and it is possible to obtain a stable sliding motion of the sliding member in the lock arm.

Further, according to a third aspect of the present invention, it is preferable that the slide slot is extended horizontally in the flexible lock arm.

Further, according to a fourth aspect of the present invention, it is preferable that the guide frame has a substantially U-shaped portion, wherein the guide frame is slidably guided in the slide slot so that the substantially U-shaped portion straddles a part of the flexible lock arm.

Further, to achieve the above object, according to a fifth aspect of the present invention, there is provided a half-fitting prevention connector which comprises:

a first connector including a first housing;

a flexible lock arm formed on the first housing, the flexible lock arm having a first retaining portion and a guide portion;

a second connector fittable to the first connector, the second connector including a second housing having a second retaining portion and a stopper portion; and a spring member attachable to the first housing, the spring member including:

a zigzag spring formed by bending a strip-shaped plate into a zigzag form, a rear end portion of the zigzag spring is fixedly secured to the first housing, and a slide member integrally formed with a front end portion of the zigzag spring, the slide member including an abutment portion and a guide section which is slidably guided by the guide portion of the flexible lock arm, wherein when the first connector and the second connector are about to be fitted to each other, the flexible lock arm is flexed while causing the abutment portion of the slide member to abut against the stopper portion of the second housing, wherein when the first connector and the second connector are incompletely fitted, the first connector and the second connector are released in a direction opposite to a connector fitting direction in accordance with a resilient force of the zigzag spring of the spring member, and wherein when the first connector and the second connector are completely fitted to each other, the first retaining portion of the flexible lock arm is retained by the second retaining portion of the second housing.

In accordance with the fifth aspect of the present invention, since the zigzag spring is formed by bending a strip-shaped plate into a zigzag form, it is easy to integrally provide the slide member and a fixing frame which is fixedly secured to a housing. Accordingly, it is possible to improve productivity and attain a further reduction in the cost.

BRIEF DESCRIPTION OF THE DRAWINGS

The above and other objects and advantages of the present invention will become more apparent by describing in detail preferred embodiment(s) thereof with reference to the accompanying drawings, wherein.

DETAILED DESCRIPTION OF THE PREFERRED EMBODIMENT

Referring now to FIGS. 1 to 5, a detailed description will be given of an embodiment of a half-fitting prevention connector in accordance with the present invention.

Figure 1:
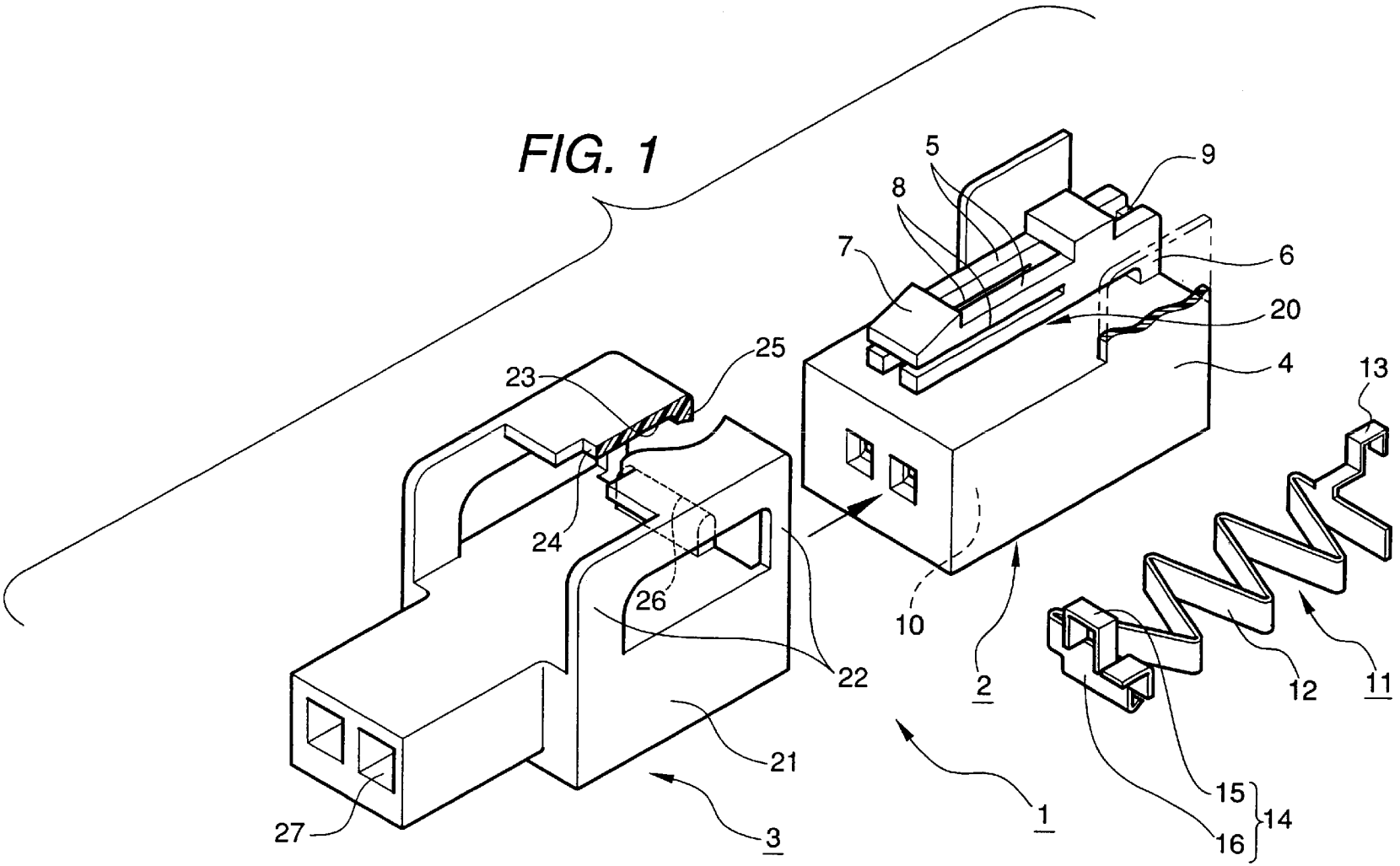
FIG. 1 is an exploded perspective view illustrating an embodiment of a half-fitting prevention connector in accordance with the present invention.
Figure 2:
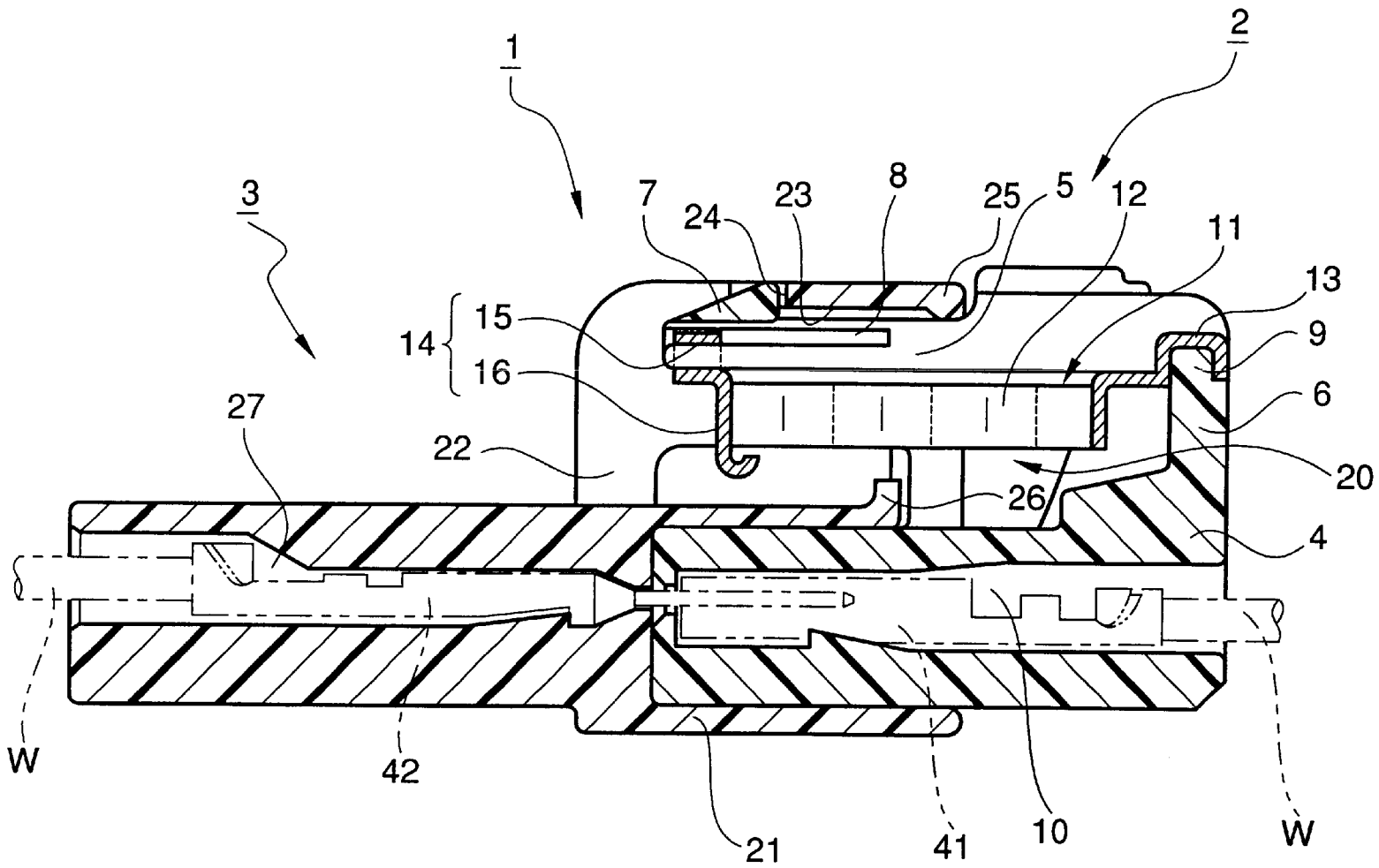
FIG. 2 is an assembled cross-sectional view illustrating a state in which male and female connectors shown in FIG. 1 are completely fitted.

As shown in FIGS. 1 and 2, a half-fitting prevention connector 1 in this embodiment is provided with a zigzag spring 12 which is formed by bending a strip-shaped plate into a zigzag form as a compression spring accommodated in a housing 4 of one male connector 2 of a pair of male and female connectors 2 and 3 which are fittable to each other, so as to prevent half-fitting between the male and female connectors 2 and 3 by the resiliency of the zigzag spring 12.

In addition, provided on a front end portion of the zigzag spring 12 is a slide member 14 which is supported slidably in the housing 4 and is adapted to cause a pair of lock arms 5, which are provided on the housing 4 and have a retaining pawl 7, to be flexible and retained in a retaining recess 24 of the mating female connector 3 in cooperation with the zigzag spring 12 during a fitting motion with the mating female connector 3. It should be noted that rear end portions of the lock arms 5 are respectively supported on a pair of flexible columns 6 provided uprightly on a rear end portion of the housing 4.

A spring member 11, in which the slide member 14 is provided with the spring function of the zigzag spring 12, is accommodated in an exclusive space 20 which is provided in an upper portion of the housing 4 in such a manner as to be juxtaposed with a pair of terminal accommodating chambers 10 provided in the housing 4. The spring member 11 is fixed to a fixing portion 9 provided on the columns 6 at the rear end of the housing 4 by a fixing frame 13 provided at a rear end portion of the zigzag spring 12.

The slide member 14 includes a guide frame 15 adapted to be guided along a pair of slide slots 8 serving as guide portions cut horizontally from distal ends of the lock arms 5. Further, the slide member 14 includes an abutment portion 16 for abutment against a stopper projection 26 of the mating female connector 3. The slide member 14 is provided integrally at the front end portion of the zigzag spring 12.

It should be noted that the aforementioned guide frame 15 is formed with an inverse U-shaped cross section in such a manner as to engage the overall widths of the slide slots 8 and straddle the lock arms 5, and is formed by being bent integrally from one side at the front end face of the zigzag spring 12. Additionally, a lower end of the abutment portion 16 is bent in a curved shape in the rearward direction.

The female connector 3 has a housing 21 into which a housing portion of the terminal accommodating chambers 10 of the housing 4 can be fitted in an enwrapped manner, and a plate-like sliding portion 23 supported by a pair of two gate-shaped pillars 22 is provided on top of the housing 21. A U-shaped retaining notch 24 is provided in a rear end of the sliding portion 23, and a tilting projection 25 for pressing the retaining pawl 7 downward is provided on a lower surface of a front end of the sliding portion 23.

In addition, the stopper projection 26 for abutment against the abutment portion 16 of the slide member 14 is provided on an upper surface of a front end of the housing 21. A pair of terminal accommodating chambers 27 are provided in a rearward lower portion of the housing 21 in such a manner as to extend in the rearward direction.

In the half-fitting prevention connector 1 having the above-described construction, the spring member 11 is placed in the exclusive space 20 on the housing 4, the fixing frame 13 of the spring member 11 is caught at the fixing portion 9 on the columns 6 so as to be fixed, and the guide frame 15 of the slide member 14, while being pulled, is inserted into the slide slots 8 in the lock arms 5 from their front ends. Then, the spring member 11 is accommodated between lower surfaces of the lock arms 5 and an upper surface of the housing 4.

Further, a pair of female terminals 41, to which covered wires W are respectively connected, are inserted into the terminal accommodating chambers 10 from their rear sides, and are positioned by retaining laces and the like. Meanwhile, a pair of male terminals 42, to which covered wires W are respectively connected, are inserted into the terminal accommodating chambers 27 in the rear portion of the housing 21 from their rear sides, and are positioned by retaining laces and the like.

Next, referring to FIGS. 2 to 5, a description will be given of the fitting operation of the connectors.

Figure 3:
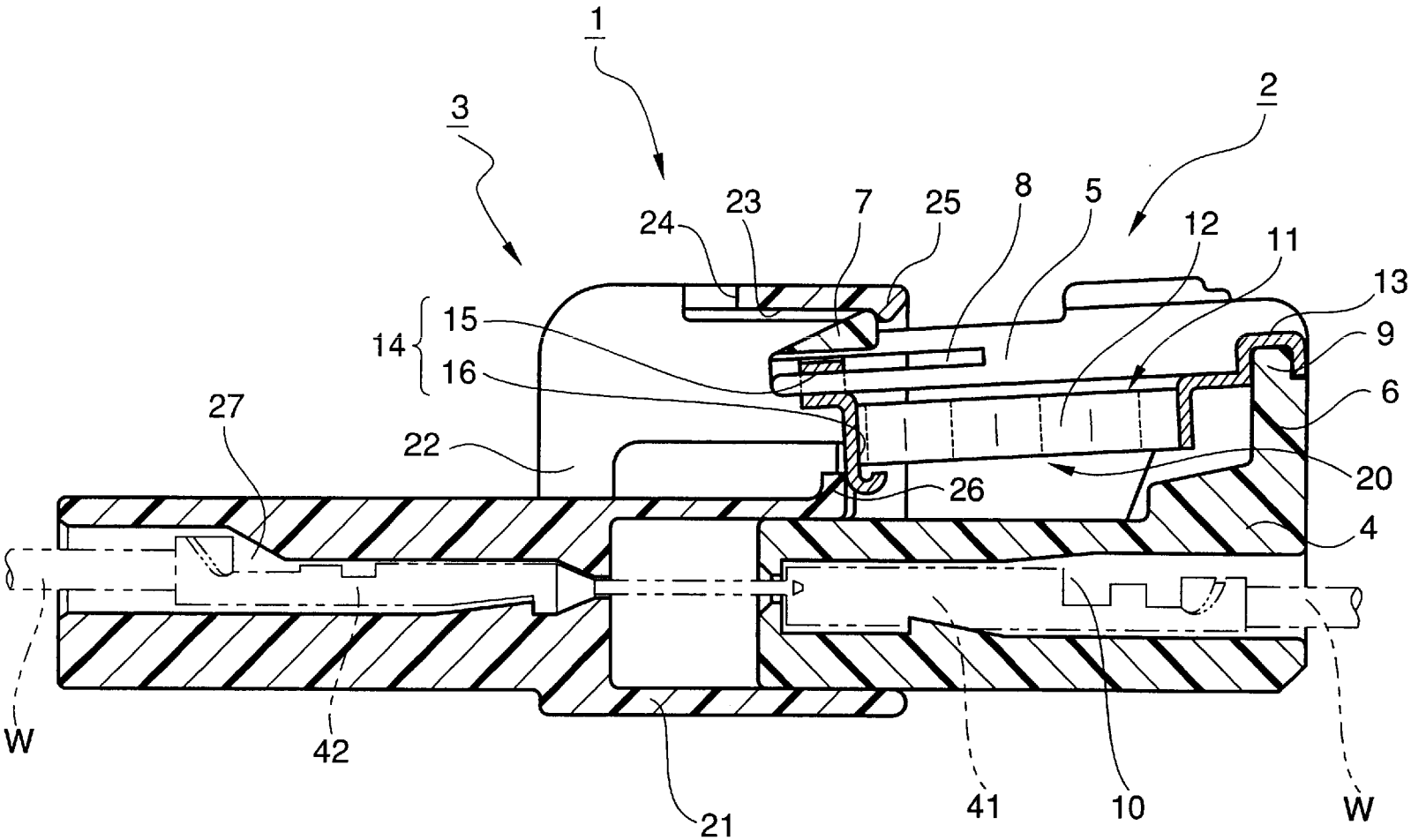
FIG. 3 is an operational diagram illustrating a state in which the male and female connectors shown in FIG. 1 start to be fitted.

First, as shown in FIG. 3, the male and female connectors 2 and 3 are made to face each other and are pressed toward each other in the connector fitting direction. Then, the front end of the tilting projection 25 abuts against the upper surface of the retaining pawl 7, so that the lock arms 5 are flexed downward together with the spring member 11.

Figure 4:
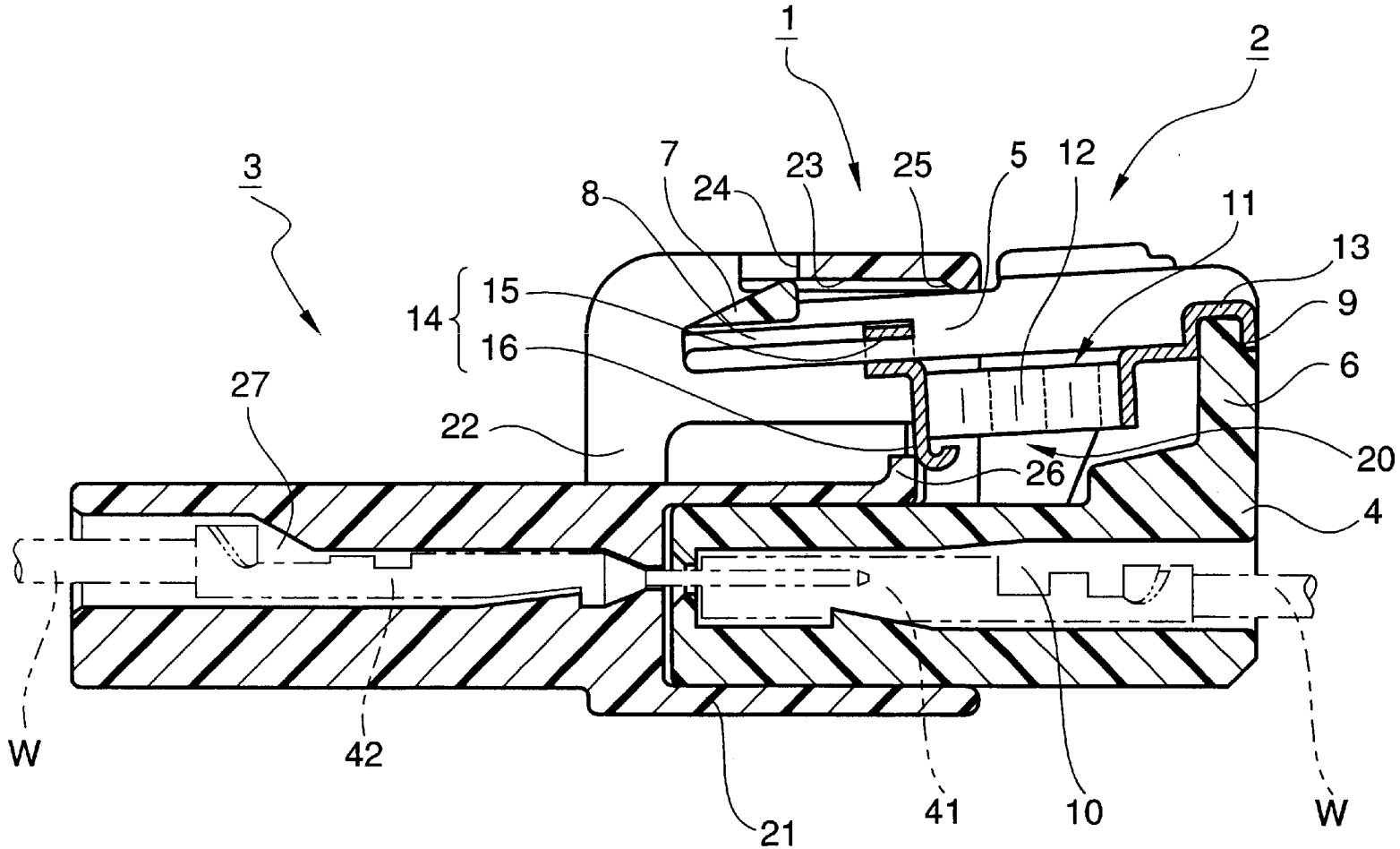
FIG. 4 is an operational diagram illustrating a state in which the male and female connectors shown in FIG. 1 are fitted halfway.

Then, since the abutment portion 16 of the slide member 14 abuts against the stopper projection 26, the zigzag spring 12 is compressed, and its urging force in the direction opposite to the connector fitting direction gradually increases. Consequently, the retaining pawl 7 moves to a position persisting immediately before engagement with the retaining recess 24, as shown in FIG. 4. This state is a final end of half-fitting, and when the fitting force is canceled in the meantime, the female connector 3 is pushed back by the urging force of the zigzag spring 12, thereby preventing the half-fitting.

Next, when the fitting operation is further advanced from the final end of half-fitting, the retaining pawl 7 is engaged in the retaining recess 24, as shown in FIG. 2. Then, the flexion of the lock arms 5 is returned to their original state, thereby assuming a completely fitted state of the connectors. Further, the abutment portion 16 at the tip of the spring member 11 is disengaged from the tip of the stopper projection 26, and the tip of the zigzag spring 12 is returned to the tips of the lock arms 5 while being supported by the guide frame 15 guided along the slide slots 8, thereby setting the zigzag spring 12 in a free state. Whether the state is the half-fitted state or the completely fitted state can be determined by visually observing the tilting of the lock arms 5 and the state of engagement between the retaining pawl 7 and the retaining recess 24.

Figure 5:
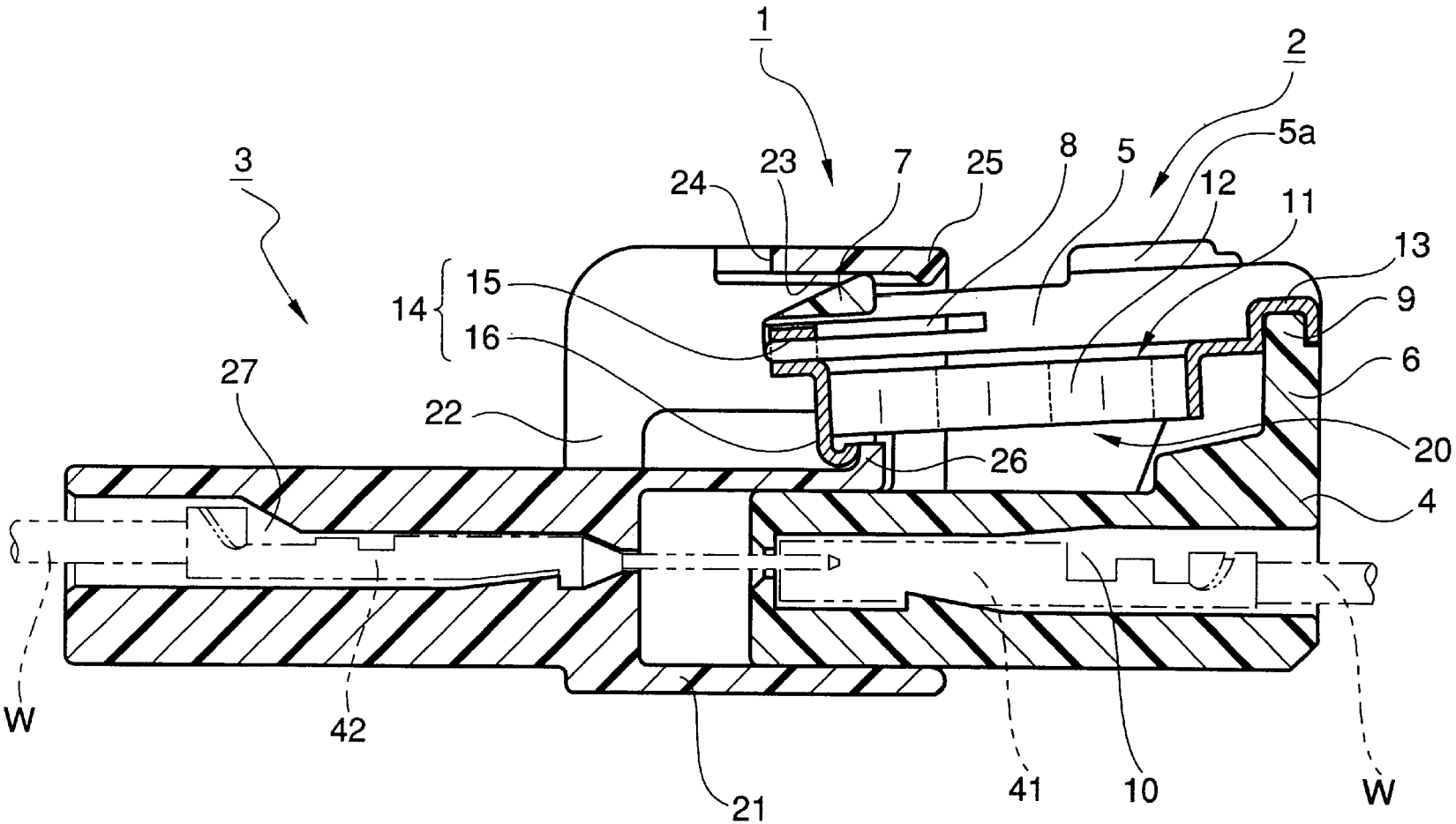
FIG. 5 is an operational diagram illustrating the male and female connectors shown in FIG. 2 at the time of releasing operation.
Figure 6:
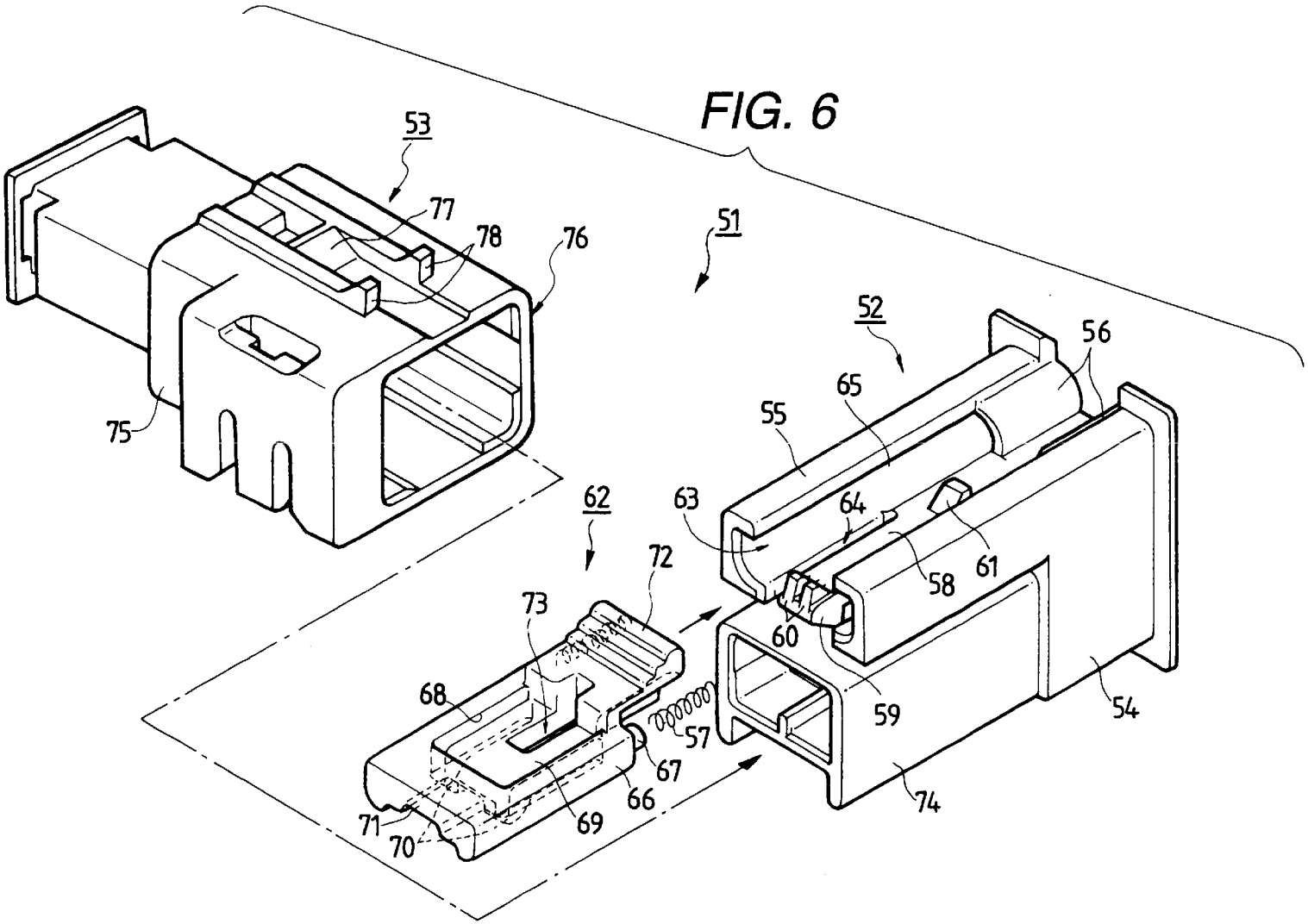
FIG. 6 PRIOR ART
FIG. 6 is an exploded perspective view illustrating a related example of a half-fitting prevention connector.
Figure 7:
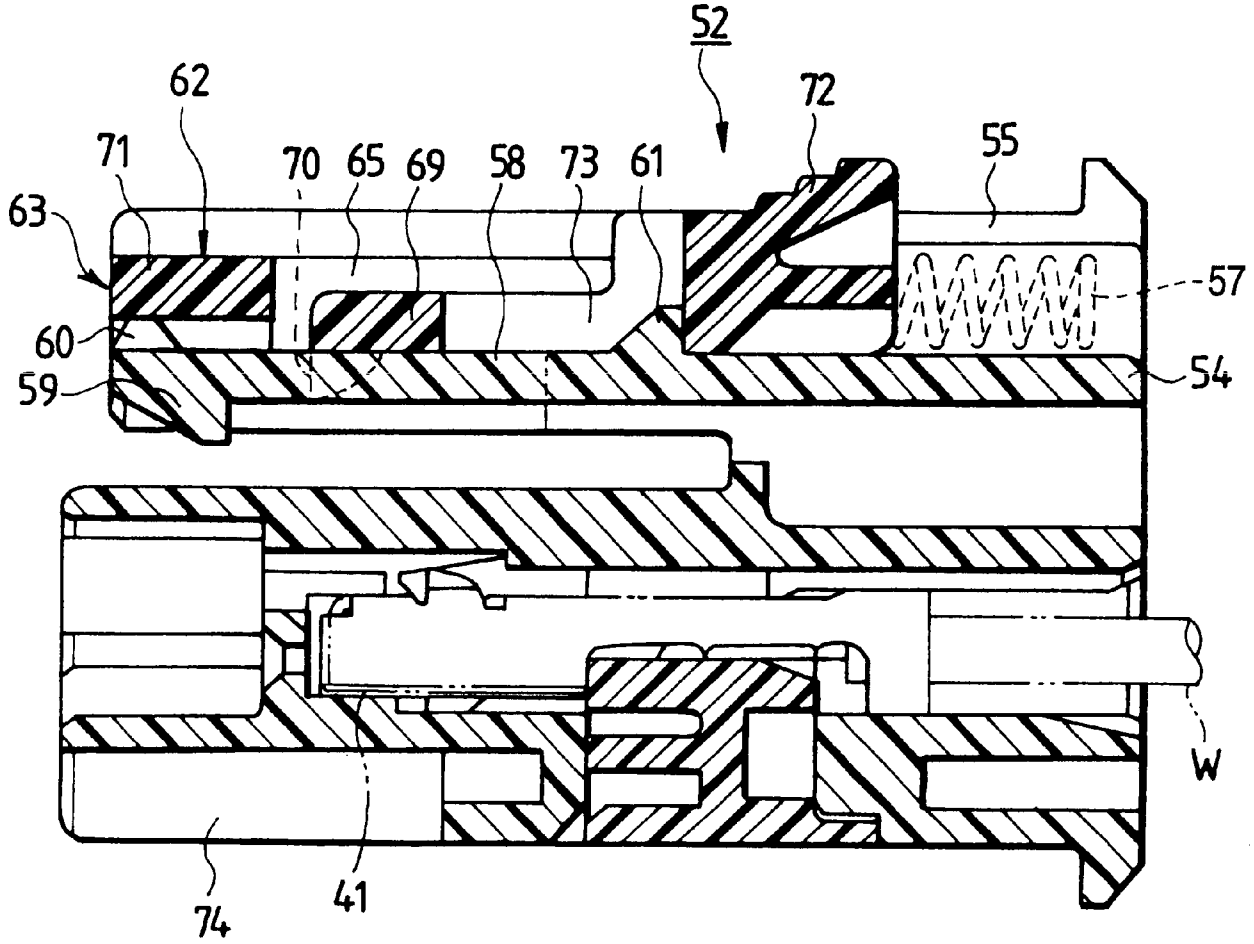
FIG. 7 is a cross-sectional view illustrating a state in which a slider shown in FIG. 6 is assembled.
Figure 8:
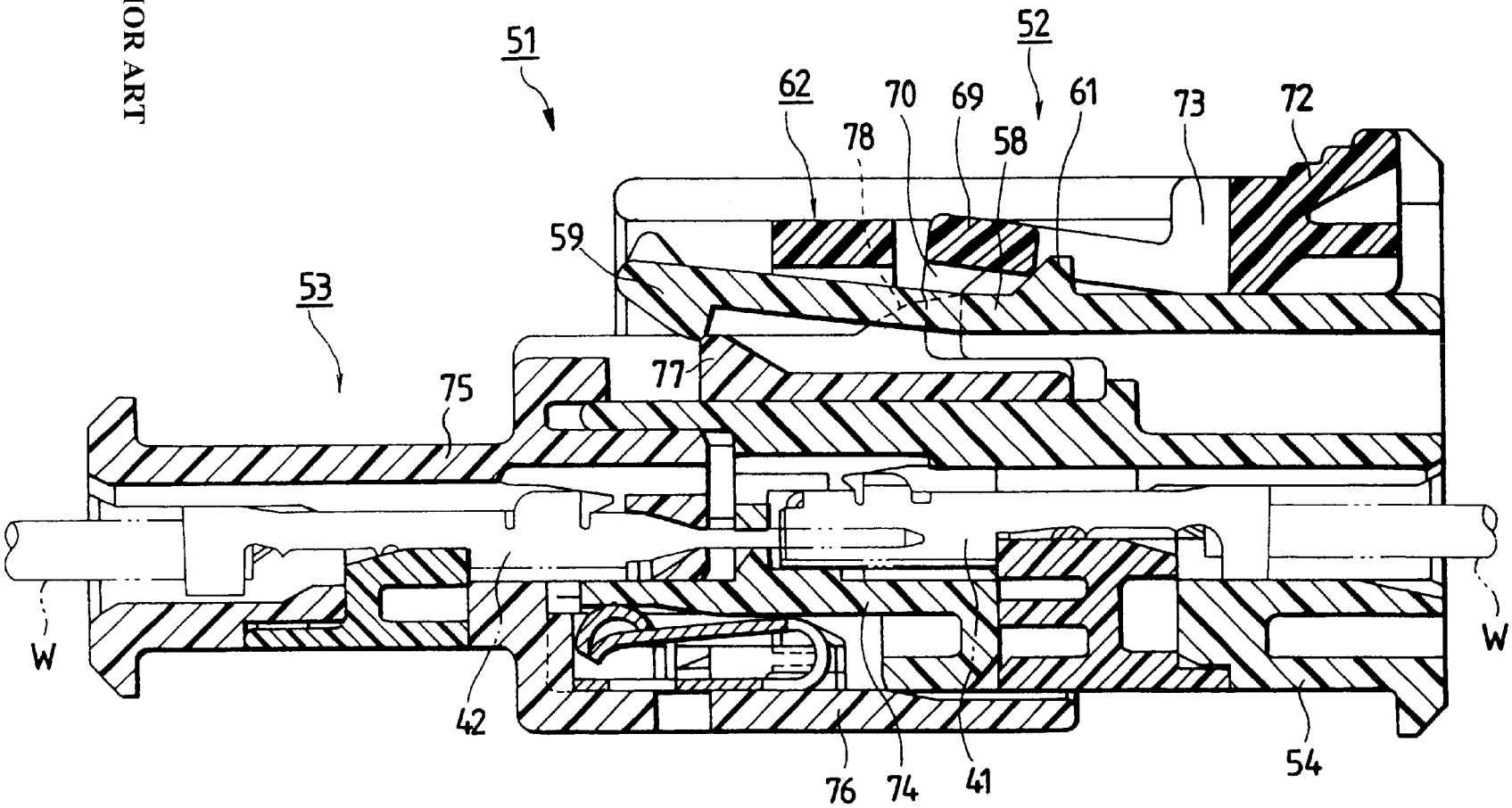
FIG. 8 PRIOR ART
FIG. 8 is an operational diagram illustrating a state in which male and female connectors shown in FIG. 6 are fitted halfway.
Figure 9:
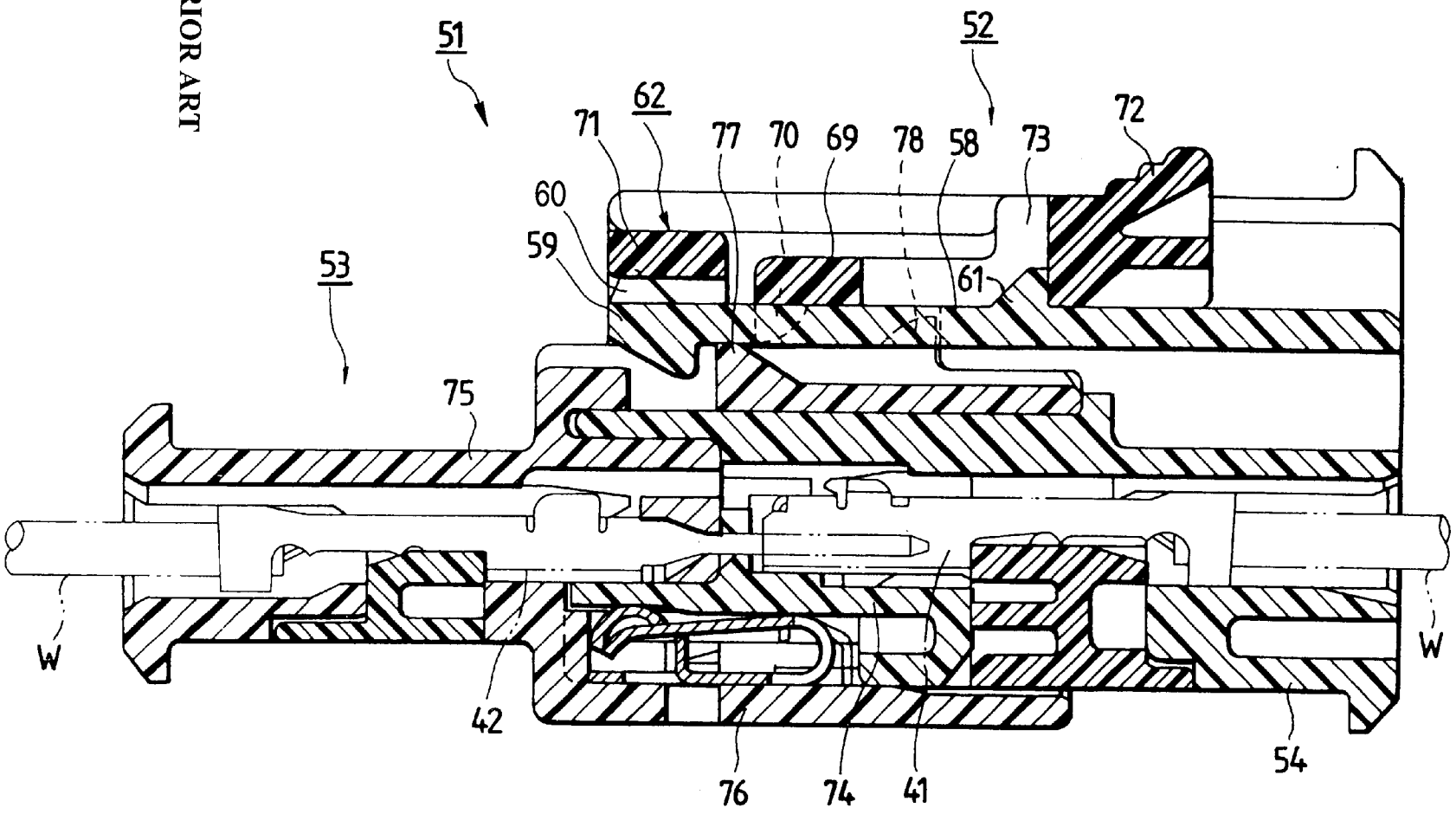
FIG. 9 is an operational diagram illustrating a state in which the male and female connectors shown in FIG. 6 are completely fitted.
Figure 10:
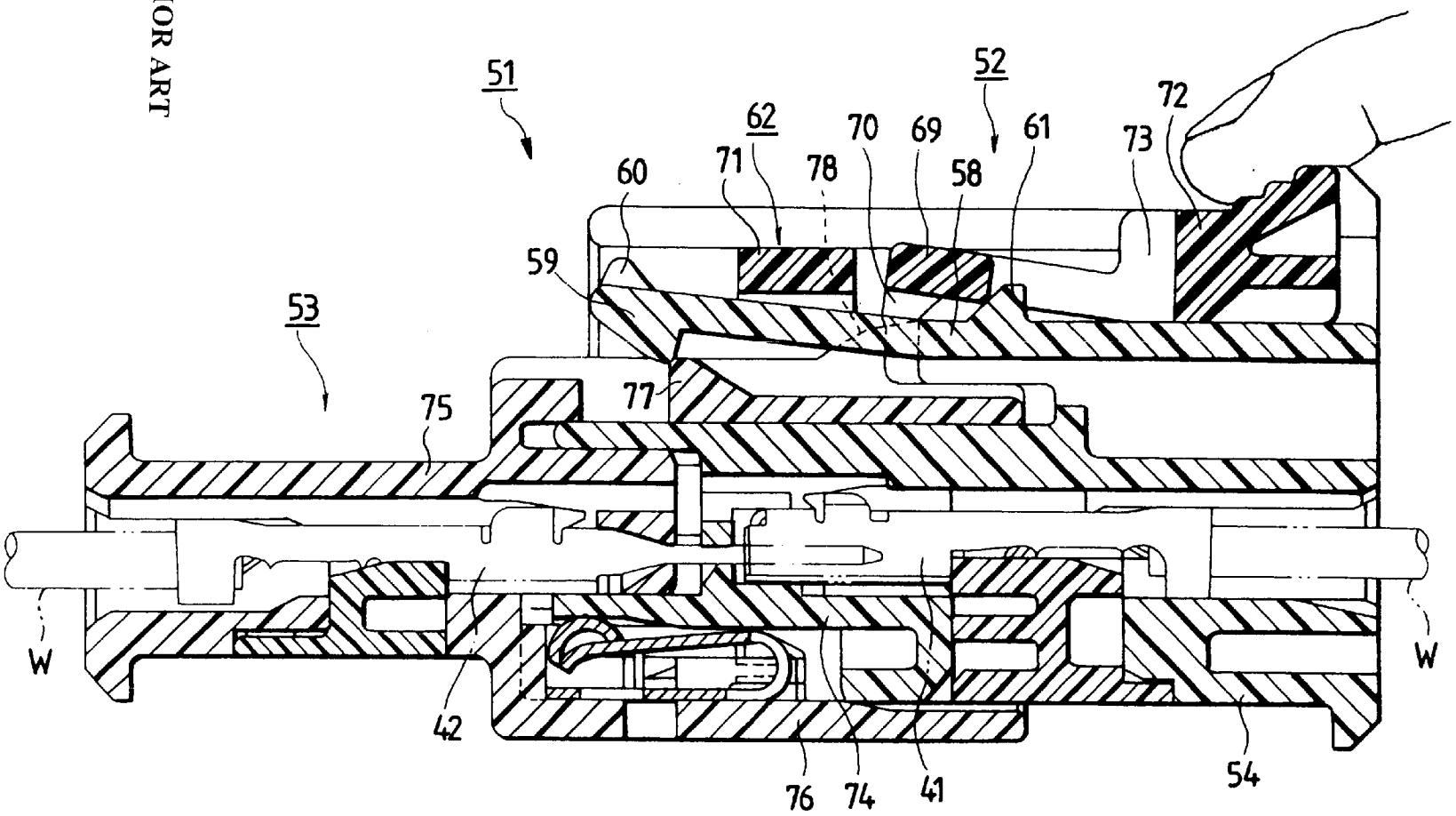
FIG. 10 PRIOR ART
FIG. 10 is an operational diagram illustrating the male and female connectors shown in FIG. 6 at the time of releasing operation.

Next, to cancel the completely fitted state of the connectors, if the operator presses an operating portion 5*a* while holding the housings 4 and 21 of the male and female connectors 2 and 3, as shown in FIG. 5, so as to cancel the engagement between the retaining pawl 7 and the retaining recess 24, and the male and female connectors 2 and 3 are pulled away from each other, the connector fitted state is easily canceled in a procedure opposite to that of the above-described fitting operation. However, since the abutment portion 16 of the spring member 11 does not abut against the stopper projection 26 even if the lock arms 5 are flexed downward, the zigzag spring 12 is in an unloaded free state during the releasing operation for the connectors. Accordingly, since the resilient force is not applied, the lock arms 5 need to be only flexed, so that the force with which the male connector 2 is pulled away from the female connector 3 can be small. It should be noted, however, that although the abutment portion 16 abuts against the rear side of the stopper projection 26 in a final stage of the releasing operation, since the lower end of the abutment portion 16 is bent in a curved manner, the abutment portion 16 is able to easily ride over the stopper projection 26.

In the half-fitting prevention connector 1 in accordance with the above-described embodiment, the spring member 11 in which the slide member 14 is provided with the spring function is accommodated in the exclusive space 20 which is provided in the upper portion of the housing 4 in such a manner as to be juxtaposed with the pair of terminal accommodating chambers 10, and the spring member 11 is fixed to the rear end of the housing 4 by the fixing frame 13 provided at the rear end portion of the zigzag spring 12. In addition, a slider is unnecessary since the slide member 14, including the guide frame 15 adapted to be guided along the pair of slide slots 8 serving as the guide portions of the lock arms 5 as well as the abutment portion 16 for abutment against the stopper projection 26 of the mating female connector 3, is provided integrally at the front end of the spring member 11. Therefore, the number of component parts is reduced, the structure is simplified, and the number of assembling steps can be reduced.

Furthermore, when the lock arms 5 tilt forward during the fitting and releasing operation of the male and female connectors 2 and 3, and the engaging pawl 7 at the tips is displaced greatly downward, the flexion of the columns 6 at the rear ends is very small. Further, since resin members other than the columns 6 of the lock arms 5 are not flexed, the durability can be improved.

In addition, since the zigzag spring 12 is not compressed during unlocking operation, it is unnecessary to pull back the operating portion 5*a* against the urging force of the spring member 11 during a connector releasing operation, so that the releasing operation is facilitated. Accordingly, it is possible to improve the operating efficiency during the connector releasing operation.

Further, the slide slots 8 serving as guide portions are formed by slots cut horizontally from distal ends of the lock arms 5, and the guide frame 15 is formed with an inverse U-shaped cross section in such a manner as to straddle the overall widths of the slide slots 8 and slidably engage therewith, so as to guide the slide member 14. Hence, the assembling operation is facilitated.

Additionally, since the zigzag spring 12 serving as a compression spring is formed by bending a strip-shaped plate into a zigzag form, the fixing frame 13 and the slide member 14 can be easily provided integrally. Hence, productivity improves, and a reduction in cost can be attained.

It should be noted that the present invention is not limited to the above-described embodiment, and maybe implemented in other forms by making appropriate modifications. For example, although in the above-described embodiment the male terminals 41 are accommodated in the terminal accommodating chambers 20 of the male connector 2, while female terminals 42 are accommodated in the terminal accommodating chambers 25 of the female connector 3, the male and female terminals 41 and 42 may be accommodated reversely. Further, although the zigzag spring 12 is used as the compression spring, a compression coil spring may be used if the sliding member 14 and the fixing frame 13 are integrally provided at the front and rear ends thereof.

It is contemplated that numerous modifications may be made to the half-fitting prevention connector of the present invention without departing from the spirit and scope of the invention as defined in the following claims.

What is claimed is:

1. A half-fitting prevention connector, comprising:

a first connector including a first housing;

a flexible lock arm formed on the first housing, the flexible lock arm having a first retaining portion and a slide slot which is formed in the flexible lock arm so as to extend from a tip of the flexible lock arm;

a second connector fittable to the first connector, the second connector including a second housing having a second retaining portion and a stopper portion; and a spring member attachable to the first housing, the spring member including:

a resilient portion, a rear end portion of which is fixedly secured to the first housing, and a slide member integrally formed with a front end portion of the resilient portion, the slide member including an abutment portion and a guide frame which is slidably guided in the slide slot of the flexible lock arm, wherein when the first connector and the second connector are about to be fitted to each other, the flexible lock arm is flexed while causing the abutment portion of the slide member to abut against the stopper portion of the second housing, wherein when the first connector and the second connector are incompletely fitted, the first connector and the second connector are released in a direction opposite to a connector fitting direction in accordance with a resilient force of the resilient portion of the spring member, and wherein when the first connector and the second connector are completely fitted to each other, the first retaining portion of the flexible lock arm is retained by the second retaining portion of the second housing.

2. The half-fitting prevention connector of claim 1, wherein the slide slot is extended horizontally in the flexible lock arm.

3. The half-fitting prevention connector of claim 1, wherein the guide frame has a substantially U-shaped portion, and where in the guide frame is slidably guided in the slide slot so that the substantially U-shaped portion straddles a part of the flexible lock arm.

4. A half-fitting prevention connector, comprising:

a first connector including a first housing;

a flexible lock arm formed on the first housing, the flexible lock arm having a first retaining portion and a guide portion;

a second connector fittable to the first connector, the second connector including a second housing having a second retaining portion and a stopper portion; and spring member attachable to the first housing, the spring member including:

a resilient portion, a rear end portion of which is fixedly secured to the first housing, and a slide member integrally formed with a front end portion of the resilient portion, the slide member including an abutment portion and a guide section which is slidably guided by the guide portion of the flexible lock arm, wherein when the first connector and the second connector are about to be fitted to each other, the flexible lock arm is flexed while causing the abutment portion of the slide member to abut against the stopper portion of the second housing, wherein when the first connector and the second connector are incompletely fitted, the first connector and the second connector are released in a direction opposite to a connector fitting direction in accordance with a resilient force of the resilient portion of the spring member, and wherein when the first connector and the second connector are completely fitted to each other, the first retaining portion of the flexible lock arm is retained by the second retaining portion of the second housing.

5. A half-fitting prevention connector, comprising:

a first connector including a first housing;

a flexible lock arm formed on the first housing, the flexible lock arm having a first retaining portion and a guide portion;

a second connector fittable to the first connector, the second connector including a second housing having a second retaining portion and a stopper portion; and a spring member attachable to the first housing, the spring member including:

a zigzag spring formed by bending a strip-shaped plate into a zigzag form, a rear end portion of the zigzag spring is fixedly secured to the first housing, and a slide member integrally formed with a front end portion of the zigzag spring, the slide member including an abutment portion and a guide section which is slidably guided by the guide portion of the flexible lock arm, wherein when the first connector and the second connector are about to be fitted to each other, the flexible lock arm is flexed while causing the abutment portion of the slide member to abut against the stopper portion of the second housing, wherein when the first connector and the second connector are incompletely fitted, the first connector and the second connector are released in a direction opposite to a connector fitting direction in accordance with a resilient force of the zigzag spring of the spring member, and wherein when the first connector and the second connector are completely fitted to each other, the first retaining portion of the flexible lock arm is retained by the second retaining portion of the second housing.

6. A half-fitting prevention connector, comprising:

a first housing;

a flexible lock arm formed on the first housing, the flexible lock arm having a retaining pawl and a slide slot which is formed in the flexible lock arm;

a second housing fittable to the first housing, the second housing including a retaining recess and a stopper projection, wherein when the first housing and the second housing are completely fitted to each other, the retaining pawl of the flexible lock arm is retained by the retaining recess of the second housing; and a spring member attachable to the first housing, the spring member including:

a slide member slidably supported by the first housing, the slide member having:

an abutment portion abutted against the stopper projection of the second housing when the first housing and the second housing are fitted to each other while flexing the flexible lock arm, and a guide frame which is slidably guided in and along the slide slot of the flexible lock arm, and a resilient portion, a front end portion of which is integrally formed with the slide member, and a rear end portion of which is fixedly secured to the first housing, wherein when the first housing and the second housing are incompletely fitted, the first housing and the second housing are released in a direction opposite to a connector fitting direction in accordance with a resilient force of the resilient portion.

* * * * *